US012716692B2

(12) United States Patent
Hall

(10) Patent No.: US 12,716,692 B2
(45) Date of Patent: Aug. 25, 2026

(54) PORTABLE BALLISTIC SHIELD WITH INTEGRATED WEAPON BRACKET

(71) Applicant: Hallas IP Group, LLC, Sheridan, WY (US)

(72) Inventor: Kennith Hall, Torrance, CA (US)

(73) Assignee: Hallas IP Group, LLC, Sheridan, WY (US)

( * ) Notice: Subject to any disclaimer, the term of this patent is extended or adjusted under 35 U.S.C. 154(b) by 0 days.

(21) Appl. No.: 19/173,431

(22) Filed: Apr. 8, 2025

(65) Prior Publication Data

US 2025/0327645 A1 Oct. 23, 2025

Related U.S. Application Data

(63) Continuation-in-part of application No. 19/000,335, filed on Dec. 23, 2024.

(60) Provisional application No. 63/636,708, filed on Apr. 19, 2024.

(51) Int. Cl.
*F41H 5/08* (2006.01)

(52) U.S. Cl.
CPC ..... *F41H 5/08* (2013.01)

(58) Field of Classification Search
CPC ..... F41H 5/08
See application file for complete search history.

(56) References Cited

U.S. PATENT DOCUMENTS

2016/0290770 A1* 10/2016 Martinez ..... F41H 5/08
2023/0417513 A1* 12/2023 Boydd ..... F41H 5/013

* cited by examiner

*Primary Examiner* — J. Woodrow Eldred

(57) ABSTRACT

In one example, a portable shield includes a first cover, a second cover, a panel, a panel retention system, and a weapon support bracket. The second cover is configured to couple to the first cover and thereby from a cavity between the first and second covers. The panel is configured to fit within the cavity and to resist penetration of a weapon-fired projectile having a kinetic energy greater than 500 foot-pounds. The panel retention system is coupled to the first or second shield cover and configured to bear the load of the panel and to hold the panel in a fixed place within the cavity. The weapon support bracket is coupled to the panel retention system and has a bracket arm selectively moveable between an extended position and a retracted position. The extended position extends the bracket arm beyond respective edges of the first and second shield covers. The bracket arm provides a surface configured to support the forend portion of a firearm.

20 Claims, 4 Drawing Sheets

PORTABLE BALLISTIC SHIELD WITH INTEGRATED WEAPON BRACKET

RELATED APPLICATIONS

The present application claims priority under 35 U.S.C. § 119 to U.S. Provisional Patent Application No. 63/636,708, titled "Ballistic Shield with Retractable Bracket," filed Apr. 19, 2024, which is hereby incorporated by reference in its entirety. In addition, this application claims priority under 35 U.S.C. § 120 as a continuation-in-part of U.S. Utility Patent Application No. 19,000,335, titled "Portable Ballistic-Resistant Shield," filed Dec. 23, 2024, which is hereby incorporated by reference in its entirety.

BACKGROUND

Ballistic protection levels are classified according to industry standards, such as NIJ (National Institute of Justice) standards and ASTM (American Society of Testing and Material), indicating the type and velocity of projectiles the protection can withstand. These levels help guide the selection of personal protective equipment based on the expected threat level. Personal protective equipment can include handheld shields, for example. Such shields may be used, for example, by SWAT teams, bomb squads, police officers, military agencies, or civilian applications that may involve ballistic impact due to gunfire.

Some ballistic-resistant material, such as bullet-proof plates, are manufactured with holes or voids therein. While such holes or voids may facilitate attaching bolts, screws, or other fasteners to ballistic-resistant material, such features may also compromise the structural integrity and performance of the ballistic-resistant material.

SUMMARY

In one example, a portable shield includes a first cover, a second cover, a panel, a panel retention system, and a weapon support bracket. The second cover is configured to couple to the first cover and thereby from a cavity between the first and second covers. The panel is configured to fit within the cavity and to resist penetration of a weapon-fired projectile having a kinetic energy greater than 500 foot-pounds. The panel retention system is coupled to the first or second shield cover and configured to bear the load of the panel and to hold the panel in a fixed place within the cavity. The weapon support bracket is coupled to the panel retention system and has a bracket arm selectively moveable between an extended position and a retracted position. The extended position extends the bracket arm beyond respective edges of the first and second shield covers. The bracket arm provides a surface configured to support the forend portion of a firearm.

In another example, a portable shield includes a shield cover, a panel retention system, and a weapon support bracket. The shield cover has a handle system configured to facilitate manual operation. The shield cover has an internal cavity having sufficient volume to receive a removable ballistic-resistant panel. The panel retention system is coupled to the shield cover and configured to bear the load of the panel and to hold the panel in a fixed place within the internal cavity. The weapon support bracket is coupled to the panel retention system and has a bracket arm selectively moveable between an extended position and a retracted position. The extended position extends the bracket arm beyond an edge of the shield cover and provides a surface configured to support the forend portion of a firearm.

BRIEF DESCRIPTION OF THE DRAWINGS

The same reference numbers or other reference designators are used in the drawings to designate the same or similar (functionally and/or structurally) features. The figures are not necessarily drawn to scale.

DETAILED DESCRIPTION

Figure 1:
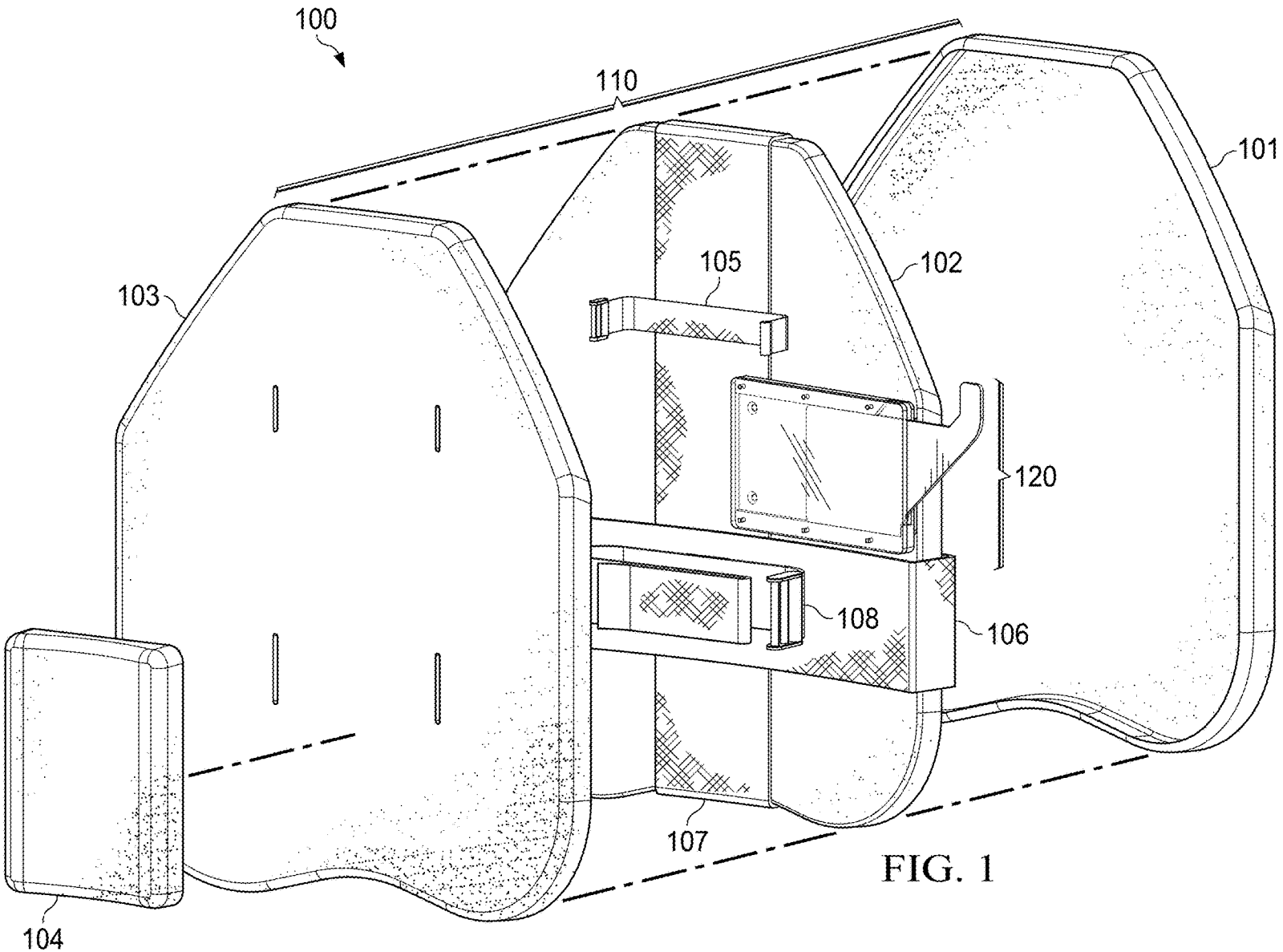
FIG. 1 is an exploded perspective view of a portable ballistic-resistant shield having a retractable weapons bracket, according to one example.

Various features are described hereinafter with reference to the figures. Other examples may include any permutation of including or excluding aspects or features that are described. An illustrated example may not have all the aspects or advantages shown. An aspect or an advantage described in conjunction with a particular example is not necessarily limited to that example and can be practiced in any other examples even if not so illustrated or if not so explicitly described.

The present disclosure relates generally, but not exclusively, to portable shields designed for personal protection against ballistic projectiles and associated threats. Ballistic projectiles can include, for example, ammunition fired by pistols, rifles, shotguns, or other firearms. Example ballistic-resistant shields are described in co-owned U.S. Pat. No. 12,152,863, filed Aug. 13, 2021, entitled "Load Bearing Cover for Integrating a Bolt Free Bullet Proof Protective Shield Having a Drop-Down Shield Cover Expansion Kit and Rifle Support Bracket and Method of use," which is incorporated herein in its entirety. Example portable ballistic-resistant shields are described in co-owned and incorporated U.S. patent application Ser. No. 19/000,335, titled "Portable Ballistic-Resistant Shield," filed Dec. 23, 2024. Certain examples disclosed herein may have features substantially similar to the Compact Response Shield®, commercially offered by Armor Research Company, Inc.

Example shields disclosed herein can have any of a variety of advantageous features. Certain example shields disclosed herein may offer personal protection for a variety of operators, such as law enforcement, military personnel, security teams, range instructors, marksman enthusiasts, civilian gun owners, and so forth. Certain operators face threats from firearm ballistics when in the line of duty. In some situations, operators have very little time to prepare for or assess a hostile situation. Although it may be standard practice for certain operators to wear soft body armor rated for a certain level of ballistic protection, some hostile situations may not present enough time for a responding operator to equip additional or different body armor rated for a higher level of ballistic protection.

In some examples, a portable shield is provided that is lightweight, compact, and easily deployable, allowing users to effectively shield themselves from various ballistic threats. The shield may at the same time have modularity that is highly adaptable to dynamic threats and that facilitates certain offensive tactics. For example, as described further below, certain example shields disclosed herein are equipped with integrated weapons support.

The integration of portable ballistic protection with weapon support can provide any of a number of technical and tactical advantages. For example, such integration can improve operator safety, mobility, maneuverability, situational awareness, and overall effectiveness. In addition, such integration can make use of both defensive protection and offensive capabilities, without the need to look for and attach separate equipment. Thus, when faced with ballistic threats, operators can quickly deploy the shield for protection while maintaining the option to quickly access and deploy firearms or other equipment using the integrated weapons support. Certain examples are configured to enable an operator to use a sight picture consistent with the operator's training and thus potentially improve accuracy and reduce training time. Such example features, among others, could be lifesaving in situations that present potential armed engagement, such as when responding to an active shooter threat.

Some shields may be equipped with integrated weapons support in the form of a weapons bracket. The weapons bracket can be designed to be retracted securely within the shield when not in use, thereby minimizing space requirements and reducing the risk of unintentionally snagging the bracket on obstacles when not in use. The weapons bracket can be large enough to accommodate most rifle fore-grips and can create a steady platform for shooting, while allowing for proper sight picture. The weapon support bracket can also facilitate one-handed shooting of a handgun when an operator places an upper forearm under the bracket. Such a feature can also provide bracing during recoil, thereby allowing for improved accuracy, pistol operation, and threat acquisition.

The shield can have a lightweight cover (e.g., 2 pounds or less) designed to be durable and resilient in the field under various weather conditions. As described further below, the cover can have a variety of external features, such as, for example, Molle (modular lightweight load carrying equipment mount) webbing and stitching, front padding, a curved, ergonomic, high-impact forearm padding, a forearm strap, and an integrated handle. In addition, the shield cover can be customized by mounting various patches, pouches, equipment, or other accessories to the front or rear Velcro Molle.

In some examples, the shield cover can include front and back covers that are designed to have manufacturing tolerances that are loose enough to reduce complexity, manufacturing time, and product development cost, but that are tight enough to ensure high quality performance and reliability. Such optimized tolerances may lower production costs while increasing production capacity and yields.

The shield can be configured to carry one or more removable and swappable internal ballistic-resistant panels. Each panel can be configured to stop penetration of certain live rounds and other projectiles. For example, certain panels can be tested for compliance with NIJ Standard 0123.00 Level HG1, HG2, RF1, RF2, and/or RF3, as described further below. Additionally, or alternatively, certain panels can be tested for compliance with the prior NIJ Standard 0108.01 (e.g., for NIJ Levels I, II, IIIA, III, or IV), or to special threat testing for NATO 7.62×39 Type 56 MSC and 5.56 M193. Some panels may meet certain NIJ Standard criteria and nevertheless be lightweight (e.g., 10 pounds or less in total, including internal panels). In some examples, each panel has a contiguous volume fully extending between its outermost edges, wherein the panel has no holes or voids extending therethrough. The absence of such holes or voids within a panel may enhance its ballistic-resistant integrity, relative to alternative panels having such holes or voids.

In some examples, an operator can quickly modify a shield in terms of the number of panels used and the type of panel(s) used (e.g., in terms of ballistic protection level). This feature may facilitate a desired balance between weight and protection level against anticipated ballistic threats. In addition, one or more used panels can be quickly replaced (e.g., on the fly) with one or more new panels of similar or different levels of ballistic protection.

Some shields include a panel retention system. The panel retention system can be removably coupled to the shield cover and configured to partially or fully bear the load of the panel(s) and to hold the panel(s) in a fixed place within an internal cavity of the shield cover. In instances where multiple panels are used, the panel retention system may facilitate maintaining a collective fixed positioning and alignment of all panels within a shield cover. The panel retention system may further facilitate securing and protecting utility accessories within the shield cover, such as, for example, a trauma kit, a flashlight, a communication system, or any other suitable accessory. The panel retention system may also facilitate the rapid swapping or replacement, and the consistent fixed positioning, of panels within a shield cover.

For additional coverage, an optional ballistic flip-down panel (e.g., as described in incorporated U.S. Pat. No. 12,152,863) can provide extended length and protection. The extension can be secured to the shield with malice clips in a hinge configuration. In some examples, the use of a ballistic flip-down panel can provide an additional coverage length of up to approx. 30 inches. The extension kit can be preconfigured with pistol or rifle rated ballistic panel inserts, for example.

In some examples, a shield is provided with a hands-free sling that allows an operator to transport or operate the shield in a variety of positions, including slung behind the operator in a back-protecting configuration. Certain shields are provided straps configured to provide protection for either the driver or passenger side windows of a vehicle. The straps can be placed through outer D-rings located on the back of the shield and can be secured around the door window frame.

The manufacturing of certain ballistic shields often requires tight manufacturing tolerances, which can increase production costs and introduce lifetime reliability issues. Such issues may arise, for example, from fabric stretching or tearing over time or from the unintentional misplacement or detachment of equipment accessories. Certain examples disclosed herein address these and other technical issues.

FIG. 1 is an exploded perspective view of a portable ballistic-resistant shield 100 according to one example. Shield 100 includes a first cover 101, one or more ballistic-resistant panel(s) 102, a second cover 103, an energy-absorbing pad 104, a handle attachment strap 105, a horizontal, load-bearing retention strap 106, a vertical load-bearing retention strap 107, a retainer strap 108, and a bracket 120. First cover 101 may operate as a "front" cover facing away from the operator and second cover 103 may operate as a "back" cover facing toward the operator.

In some examples, handle attachment strap 105, load-bearing retention strap 106, vertical load-bearing retention strap 107, and retainer strap 108 are subcomponents of a panel retention system 110. Each subcomponent 105-108 of panel retention system 110 can individually operate, or all subcomponents can collectively 105-108 operate, to be load-bearing, including by bearing the load of panel(s) 102 and bracket 120 retained by panel retention system 110. The panel retention system 110 can offer secure and dependable attachment for covers 101/103 and various features that optionally can be attached thereto (e.g., pad 104 and bracket 120). Panel retention system 110 can be configured to securely fix in place and properly align one or more fully contiguous panel(s) 102 within a cavity between first and second shield covers 101/103. Such a feature may be contrasted, for example, with other shields having ballistic-resistant plates with holes or voids channeled therethrough (e.g., for attaching fasteners thereto), which could compromise ballistic-resistant integrity of the plates.

As shown in FIG. 1, shield 100 can incorporate one or more sloped or angled cutouts shaped to allow an operator to see or aim while remaining protected in areas both above and below the line of sight. In some examples, the cutouts are positioned between top and side edges of shield 100, from the perspective of an upright orientation of the shield 100. The use of cutouts can be distinguished, for example, from the use of transparent ballistic material for windows positioned proximate to a center of the shield, which can cause diffraction of incident light beams (and thereby reduce aiming accuracy), which can introduce impact variance, and which can expose an operator to a less protected, or even an unprotected, line of fire.

In some examples, shield 100 includes symmetric cutouts on both sides thereof. The use of symmetric cutouts on both sides of shield 100 may improve flexibility in operational use and accommodate both right-handed and left-handed operators. In the illustrated example, each cutout of shield 100 has a single outer edge having a first end joined to a top edge of the shield 100 and a second opposite end joined to a side of the shield 100, in which the majority of the outer edge of the cutout is aligned along a line that is at an angle (e.g., +/−45 degrees, or within the range of +/−30 degrees to +/−60 degrees) relative to respective lines most aligned to the top and side edges of shield 100. However, other cutout configurations may be used. For example, a cutout may include a first and second edges joined together at an angle within the range of 45 to 135 degrees (e.g., 90 degrees).

Shield 100 can have a configurable design that facilitates manufacturing various sizes and weights, thereby offering flexibility for different tactical scenarios. Some examples can be configured to be lightweight, while nevertheless providing immediate and mobile ballistic protection to an operator. Shield 100 can be designed to be portable and quickly deployable, allowing an operator to move efficiently and adapt in dynamic situations.

As described further below, shield 100 can include a handle or grip for enhanced maneuverability and control while being used in a handheld configuration. In addition, shield 100 may have a modular design that allows the operator to customize the shield in accordance with operational needs. The modular design may facilitate, for example, the optional use of built-in lighting, communication systems, or attachment points for accessories.

Ballistic protection levels are classified according to industry standards, such as NIJ and ASTM, indicating the protective gear's ability to resist penetration. The table below specifies the test threats, the specific ammunition to be used, and the reference velocities to be used for NIJ Ballistic Protection Levels and Associated Test Threats, according to NIJ Standard 0123.00. In the table below, "HG" refers to handgun threats and "RF" refer to rifle threats.

| NIJ Level | Test Threat | Velocity | Approx. Kinetic Energy (in foot-pounds and Joules) |
|---|---|---|---|
| HG1 | 9 mm Luger FMJ RN 124 grain | 1305 ft/s (398 m/s) | 468.53 ft-lbf 635.81 Joules |
| | .357 Mag JSP 158 grain | 1430 ft/s (436 m/s) | 715.87 ft-lbf 969.5 Joules |
| HG2 | 9 mm Luger FMJ RN 124 grain | 1470 ft/s (448 m/s) | 593.2 ft-lbf 804.5 Joules |
| | .44 Mag JHP 240 grain | 1430 ft/s (436 m/s) | 1,086.5 ft-lbf 1,472.8 Joules |
| RF1 | 7.62 × 51 mm M80 Ball NATO FMJ Steel Jacket 147 + 0/−3 grain | 2780 ft/s (847 m/s) | 2,520.3 ft-lbf 3,413.5 Joules |
| | 7.62 × 39 mm MSC Ball Ammunition Type 56 from Factory 31 | 2400 ft/s (732 m/s) | 1,573.4 ft-lbf 2,131.5 Joules |
| | 5.56 mm M193 56 + 0/−2 grain | 3250 ft/s (990 m/s) | 1,308.4 ft-lbf 1,773.4 Joules |
| RF2 | 7.62 × 51 mm M80 Ball NATO FMJ Steel Jacket 147 + 0/−3 grain | 2780 ft/s (847 m/s) | 2,520.3 ft-lbf 3,413.5 Joules |
| | 7.62 × 39 mm MSC Ball Ammunition Type 56 from Factory 31 | 2400 ft/s (732 m/s) | 1,573.4 ft-lbf 2,131.5 Joules |
| | 5.56 mm M193 56 + 0/−2 grain | 3250 ft/s (990 m/s) | 1,308.4 ft-lbf 1,773.4 Joules |
| | 5.56 mm M855 61.8 ± 1.5 grain | 3115 ft/s (950 m/s) | 1,333.8 ft-lbf 1,806.9 Joules |
| RF3 | 30.06 M2 AP 165.7 + 0/−7 grain | 2880 ft/s (878 m/s) | 3,047.7 ft-lbf 4,131.5 Joules |

In the above table, the kinetic energy (Ek) of a projectile is calculated using the formula:

$$E_k = \frac{1}{2}mv^2$$

Where:

$E_k$ is the kinetic energy in foot-pounds (ft-lbf) or Joules (J), m is the mass of the projectile in pounds (lbf) or kilograms (kg), v is the velocity of the projectile in feet per second (ft/s) or meters per second (m/s).

In some examples, shield 100 complies with the NIJ Standard 0123.00 Level HG1, HG2, RF1, RF2, and/or RF3. In terms of absorbing kinetic energy, shield 100 may be capable of stopping a ballistic projectile having kinetic energy of 469 ft-lbf (636 J), 716 ft-lbf (970 J), 594 ft-lbf (805 J), 1,087 ft-lbf (1,473 J), 2,521 ft-lbf (3,414 J), 1,574 ft-lbf (2,132 J), 1,309 ft-lbf (1,774 J), 2,521 ft-lbf (3,414 J), 1,574 ft-lbf (2,132 J), 1,309 ft-lbf (1,774 J), 1,334 ft-lbf (1,807 J), or 3,048 ft-lbf (4,132 J). In terms of achieving certain kinetic energy stoppage thresholds, shield 100 may be capable of stopping a ballistic projectile having a kinetic energy greater than or equal to 500 ft-lbf (677.91 J), 1,000 ft-lbf (1,355.82 J), 1,500 ft-lbf (2,033.73 J), 2,000 ft-lbf (2,711.64 J), 2,500 ft-lbf (3,389.55 J), or 3,000 ft-lbs (4,067.46 J). Stated in other terms, shield 100 may be capable, for example, of stopping a ballistic projectile having a kinetic energy less than or equal to 3,100 ft-lbf, or less than or equal to 2,600 ft-lbf.

Sheild 100 may be used, for example, by SWAT teams, bomb squads, police officers, military agencies, or civilian applications that may involve ballistic impact due to gun fire. For example, shield 100 may be configured to provide protection to an operator who is advancing toward or retreating from a potentially dangerous situation, such as when providing cover during hostage rescues, active shooter incidents, or other high-threat environments.

Shield 100 may be deployed in a variety of hostile situations. In the event of an active shooter incident, for example, swift response is critical to saving lives by minimizing the duration between dispatch and engagement with the threat. Given the paramount importance of time once preventive measures are ineffective, certain examples include features facilitating deployment of a mobile ballistic barrier equipped with a rifle mount and adaptable for handgun support attachments. Shield 100 can thereby enhance safety for solo or multiple officer responders. By providing protection for a single operator, or multiple operators working in tandem, certain examples can significantly reduce response time, thereby limiting the window of opportunity for the threat to cause harm.

First and second covers 101/103 can include lightweight, durable, impact-resistant material designed to withstand certain impacts or physical assaults. For example, first and second covers 101/103 can each be constructed of 1000D Cordura; however, any suitable material may be used.

First and second covers 101/103 can be configured to couple to one another, thereby providing an enclosed cavity therebetween having sufficient volume to fully encase one or more panel(s) 102 and, optionally, additional utility accessories. As shown in FIG. 1, in some examples, first and second covers 101/103 couple together in a clamshell configuration, in which first cover 101 has a first lip extruded around all or most of a periphery edge thereof, second cover 103 has a second lip extruded around all or most of a periphery edge thereof, and the first and second lips are shaped and positioned to overlap with one another when the covers 101/103 are coupled together, such that an outer surface of the lip of one cover 101/103 forms a friction fit or otherwise interlocks within an inner surface of the lip of the other cover 101/103. The use of a clamshell configuration may allow for reduced tolerances in manufacturing, thereby lowering production costs while increasing production capacity and yields. Such a configuration may also facilitate, for example, the routing of any wires needed for attachable lights or other accessories.

In some examples, first and second covers 101/103 are fully detachable from one another, as shown in the exploded view of FIG. 1. In some examples, first and second covers 101/103 are connected together on respective ends thereof (e.g., via a hinge), and are configured to rotate toward or away from one another to facilitate sealing or accessing, respectively, an interior of shield 100. For example, first and second covers 101/103 can be connected portions of a contiguous shield case having a sealable opening through which one or more panel(s) 102 may be inserted or removed as needed.

In some examples, once front and second covers 101/103 are connected to one another with panel(s) 102 positioned therebetween, front and second covers 101/103 can be secured in place (e.g., using overlapping Velcro extending around the edge of shield 100). Such a configuration may facilitate accessing the interior of shield 100, making replacements or adjustments as desired to the interior of shield 100, and then reconnecting front and second covers 101/103.

First cover 101 or second cover 103 (or both) can include a Molle feature, which can be laser cut on a respective surface thereof. The Molle feature can include Velcro including (e.g., on the inside lips and centerline). The cooperative use of a Molle feature and Velcro may provide certain operation advantages. The Velcro can include a Velcro loop that is securely bonded to a backing material to enhance strength and durability. Once bonded, the configuration can be efficiently cut using either a laser or a clicker die, which can improve manufacturing speed and precision. Such an example configuration can enable the secure fastening of heavier loads, while also accommodating lighter, easily accessible items that can be held solely by Velcro, thereby potentially improving versatility. Additionally, various identification panels can be effortlessly added or changed as needed.

Second cover 103 can include features for integrating one or more load-bearing straps. The load-bearing strap(s) may be configured to facilitate secure carrying and handling of the shield. For example, second cover 103 can include open slots extending therethrough to allow retainer strap 108 to be inserted and protrude therethrough.

Ballistic-resistant panel 102 generally refers to a protective component designed to absorb and deflect the impact of projectiles, such as fired ammunition, to prevent penetration and reduce injury. Panel 102 can be constructed from any suitable material(s) engineered and tested to withstand specific ballistic threats based on their rating. For example, panel 102 may include metallic material, such as titanium, stainless steel, carbon steel, or superalloys, for example. Panel 102 may additionally or alternatively include non-metallic material, such as Kevlar, Aramid fibers, ceramic tiles, or high-strength composites, for example. A given panel 102 may include a combination of metallic and non-metallic material. In addition, an operator may opt to include within a shield 100 different kinds of panels 102, such as both metallic and non-metallic panels 102. Certain panel(s) 102 can have a contiguous design that is boltless or unperforated (i.e., lacks any holes or voids therethrough), thereby enhancing integrity and performance.

In some examples, a single panel 102, or a stack of multiple panels 102 aligned with one another, may provide sufficient ballistic protection to achieve compliance with the NIJ Standard 0123.00 Level HG1, HG2, RF1, RF2, and/or RF3 for a given shield 100. In terms of absorbing kinetic energy, one or more panel(s) 102 may be individually or collectively capable of stopping a ballistic projectile having a kinetic energy of 469 ft-lbf (636 J), 716 ft-lbf (970 J), 594 ft-lbf (805), 1,087 ft-lbf (1,473 J), 2,521 ft-lbf (3,414 J), 1,574 ft-lbf (2,132 J), 1,309 ft-lbf (1,774 J), 2,521 ft-lbf (3,414 J), 1,574 ft-lbf (2,132 J), 1,309 ft-lbf (1,774 J), 1,334 ft-lbf (1,807 J), or 3,048 ft-lbf (4,132 J). In terms of achieving certain kinetic energy stoppage thresholds, use of a single panel 102, or use of stack of multiple panels 102 aligned with one another, may be tested to stop a ballistic projectile having a kinetic energy greater than or equal to 500 ft-lbf (677.91 J), 1,000 ft-lbf (1,355.82 J), 1,500 ft-lbf (2,033.73 J), 2,000 ft-lbf (2,711.64 J), 2,500 ft-lbf (3,389.55 J), or 3,000 ft-lbs (4,067.46 J).

Panel 102 can have a curved shape (e.g., a concave surface curvature), in which the concave shape defines at least part of a gap between a central axis of an innermost (or only) panel 102 and second cover 103. The gap may be of sufficient size (e.g., a maximum length of 16 inches to 26 inches or a minimum, a maximum depth of 0.5 to 2.5 inches, and a maximum volume of 294 square inches to 364 square inches) to allow for the storage of various hardware, such as first-aid kits, a tourniquet, a communication system, a flashlight, or any other desired utility item. In a particular example, a surface of the panel 102 opposing the second cover 103 is spaced apart from the second cover 103 by at least 1 inch along a linear axis at least 10 to 16 inches in length. In addition, the gap between an innermost (or only) ballistic panel 102 and second cover 103 can enhance energy absorption during the dissipation of kinetic energy from high-energy ballistic projectiles (e.g., fired ammunition). The use of one or more curved panel(s) 102, in combination with certain other optional features of shield 100 (e.g., energy-absorbing pad 104), may further enhance dispersing kinetic energy and force vectors generated by high-velocity ballistic projectiles.

Energy-absorbing pad 104 can be configured for use as a shock absorber (e.g., responsive to the impact-effect of a ballistic projectile). In addition, pad 104 can be configured to protect the forearm from any back-face protrusions during a ballistic encounter. In some examples, pad 104 is configured for cooperative use with retainer strap 108, in which synching retainer strap 108 with an arm inserted therethrough wedges the pad 104 in place against an opposing surface of second cover 103. Pad 104 may additionally or alternatively be adjustably held in place against second cover 103 at a desired location using any suitable attachment mechanism, such as snaps or Velcro, for example.

In some examples, panel retention system 110 includes handle attachment strap 105, horizontal retention strap 106, vertical retention strap 107, and retainer strap 108, wherein each subcomponent 105-108 can individually operate, or all subcomponents can collectively 105-108 operate, to be load-bearing.

Handle attachment strap 105 can be configured as part of a panel retention system (including components 105-108) configured to hold ballistic panels 102 in place between first cover 101 and second cover 103. Handle attachment strap 105 can be configured to provide a solid mounting point of the overall retention system and can include protrusions configured to extend through corresponding openings in second cover 103. Handle attachment strap 105 can further be configured, for example, to help support the weight of the shield. In some examples, handle attachment strap 105 is permanently attached to vertical retention strap 107 (e.g., by sewing or gluing).

Horizontal retention strap 106 can be configured as part of the panel retention system (including components 105-108) configured to hold ballistic panels 102 in place between first cover 101 and second cover 103. Horizontal retention strap 106 can be configured to wrap around ballistic panel(s) 102 in a lateral orientation. Horizontal retention strap 106 can be equipped with a buckle at one end, in which the buckle receives the other end of horizontal retention strap 106 and allows tensioning as desired before locking horizontal retention strap 106 in place (e.g., through the use of Velcro) with the desired tension.

Vertical retention strap 107 can be configured as part of the panel retention system (including components 105-108) configured to hold ballistic panels 102 in place between first cover 101 and second cover 103. Vertical retention strap 107 can be configured to wrap around ballistic panels (102) in a vertical orientation that is orthogonal to the wrapping direction of horizontal retention strap 106. Vertical retention strap 107 can be configured to wrap around ballistic panel(s) 102 in a horizontal orientation that is orthogonal to the lateral orientation of the horizontal retention strap 106. Vertical retention strap 107 can be equipped with a buckle at one end, in which the buckle receives the other end of vertical retention strap 107 and allows tensioning as desired before locking vertical retention strap 107 in place (e.g., through the use of Velcro) with the desired tension. In some examples, horizontal retention strap 106 and vertical retention strap 107 may be sewn or otherwise attached to one another in a cross-life configuration.

Retainer strap 108 is coupled to the panel retention system (e.g., by sewing to opposing portions of horizontal retention strap 106) and can be configured to provide solid mounting for use in manipulation of the shield 100. Retainer strap 108 includes straps configured to be inserted through associated slots in the second cover 103. In some instances, retainer strap 108 can provide attachment points for the forearm and a handle for hardware. Retainer strap 108 can also have a Velcro loop attached in such a way as to provide attachment points for pad 104.

In some examples, the panel retention system 110 (including components 105-108) can be configured to not only hold one or more ballistic panel(s) 102 in place between first cover 101 and second cover 103, but also to secure shield 100 in place with the ballistic panel(s) 102 positioned at a desired protective location relative to the operator. In addition, the use of a panel retention system 110 (including components 105-108) that includes a retainer strap 108 extending through second cover 103 and outside of shield 100, may facilitate the use of certain rigid mounting features (e.g., on an operator-facing surface of shield 100) to which any of a variety of customizable accessories may be attached.

In this example, shield 100 has a bracket 120 designed to support a firearm (e.g., rifle or handgun) or other equipment. For example, bracket 120 can be designed to accommodate most rifle or shotgun fore-grips and can create a steady platform for shooting, while allowing for proper sight picture. Bracket 120 can also facilitate one-handed shooting of a handgun when an operator places an upper forearm under the bracket. Such a feature can also provide bracing during recoil, thereby allowing for improved accuracy, pistol operation, and threat acquisition. Bracket 120 may feature adjustable components or interchangeable adapters to accommodate different weapons or weapon sizes and configurations. In addition, bracket 120 can be adaptable for other equipment attachments (e.g., backup handgun supports). Example configurations and accessories for bracket 120 are described further in U.S. Provisional Patent Application No. 63/636,708, titled "Ballistic Shield with Retractable Bracket."

In some examples, the compact, integrated, and ergonomic design of bracket 120 can facilitate rapid response by improving mobility and maneuverability, without the need to look for and attach additional equipment accessories that may be required under the circumstances. Such features could be lifesaving in situations that present potential armed engagement, such as when responding to an active shooter threat. Use of bracket 120 can improve operator safety, situational awareness, and overall effectiveness. Bracket 120 can also facilitate using a sight picture consistent with an operator's training, which may improve accuracy and reduce training time.

In some examples, bracket 120 can be removably mounted to an exterior of shield 100 (e.g., using a MOLLE mounted to front cover 101 or back cover 103). Additionally, or alternatively, bracket 120 can be mounted to, or can be an integrated portion of, an interior feature of shield, as shown, for example, in FIGS. 1 and 3. As described further below with reference to FIGS. 2A and 2B, a housing portion 210 of bracket 120 can be securely fastened to vertical load-bearing retention strap 107 (e.g., using multiple fasteners).

Bracket 120 is optionally configured to be positioned proximate to a cutout at either side of the shield 100, which may facilitate universal or ambidextrous use, regardless of the dominant shooting hand of an operator. Such a feature may also enable an operator to use a sight picture consistent with the operator's training, which may improve accuracy and reduce training time.

Figure 2A:
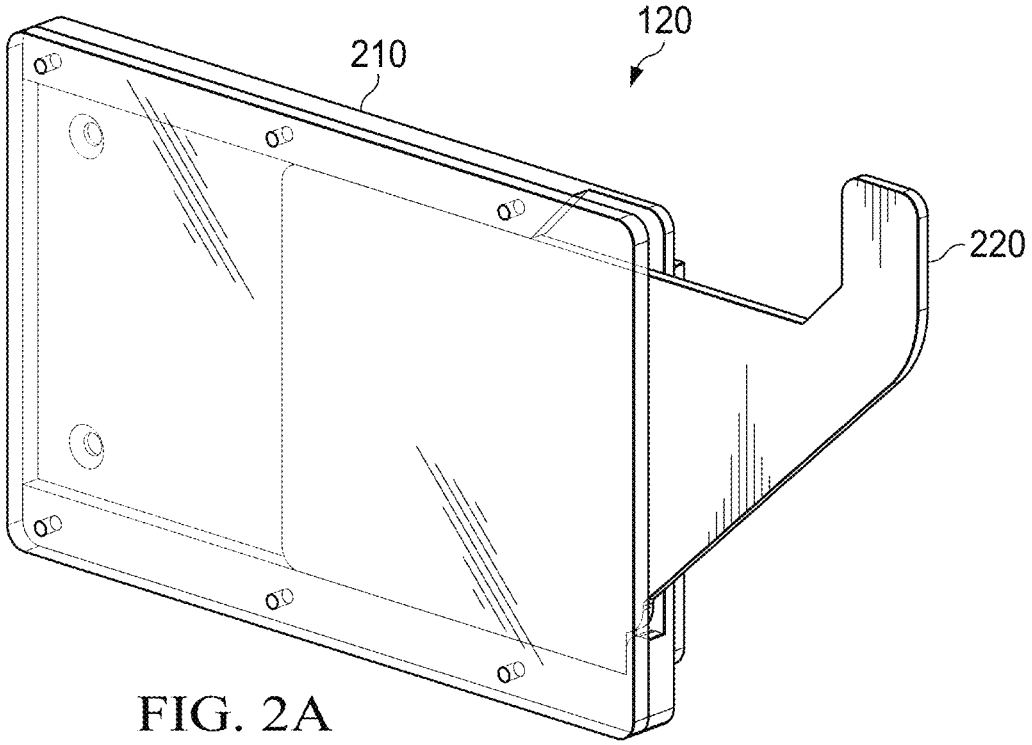
FIG. 2A is a perspective view of the weapons bracket of FIG. 1 in an extended or deployed position of FIG. 1, according to one example.
Figure 2B:
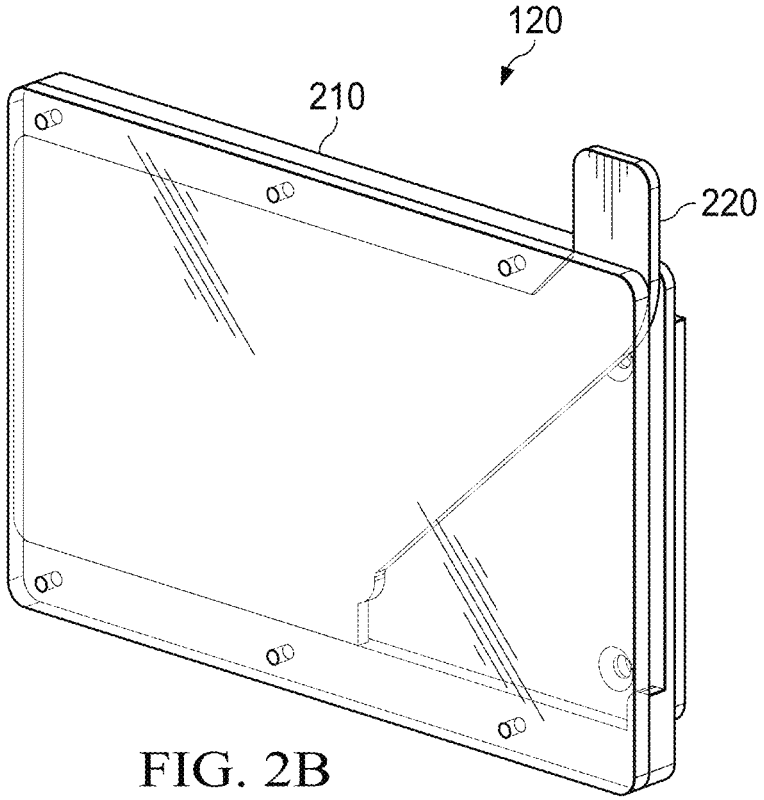
FIG. 2B is a perspective view of the weapons bracket of FIG. 1 in a retracted position of FIG. 1, according to one example.
Figure 3:
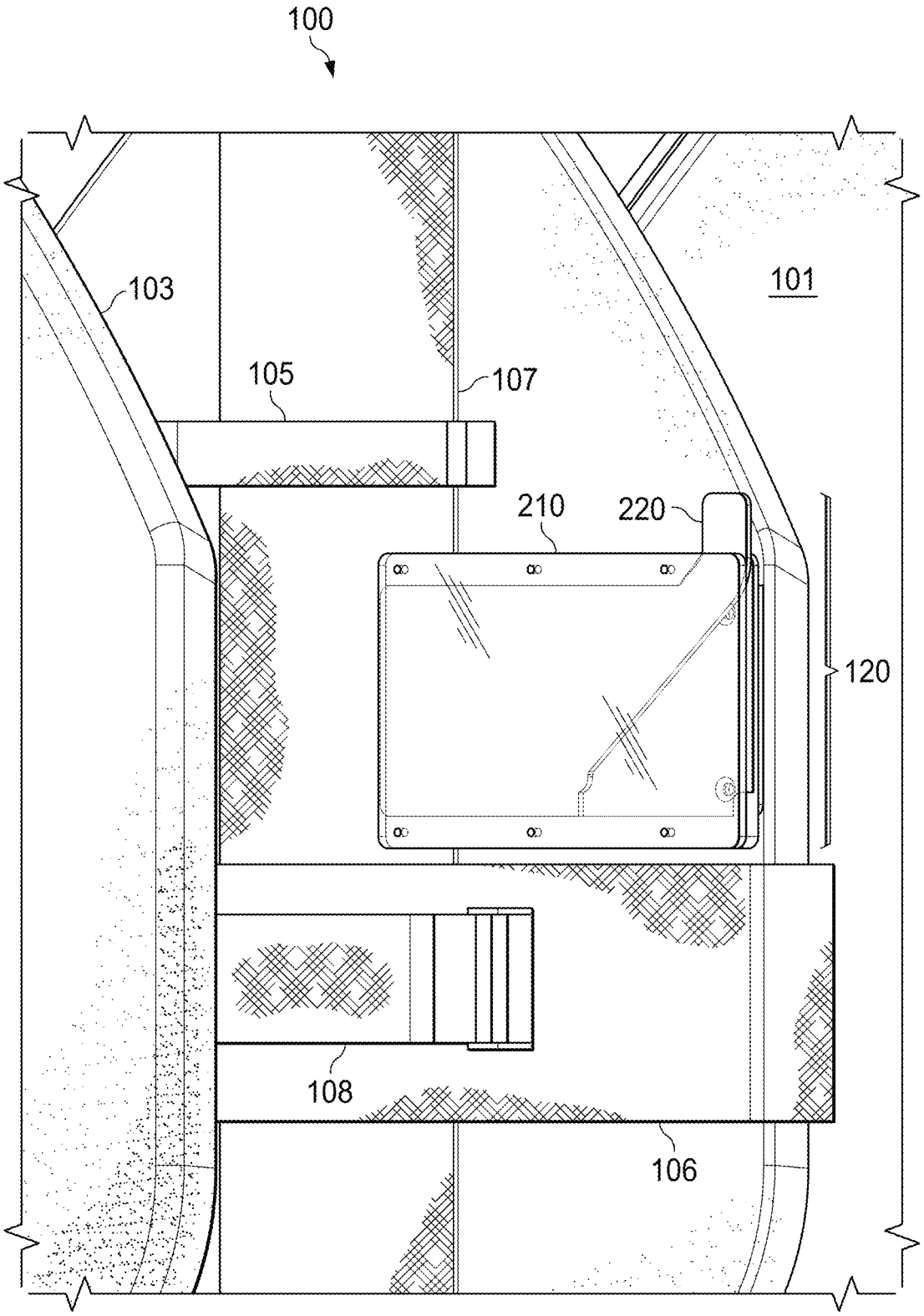
FIG. 3 is a rear-facing, exploded perspective view of a portion of the shield of FIG. 1, in which the weapons bracket is in a retracted position, according to one example.
Figure 4:
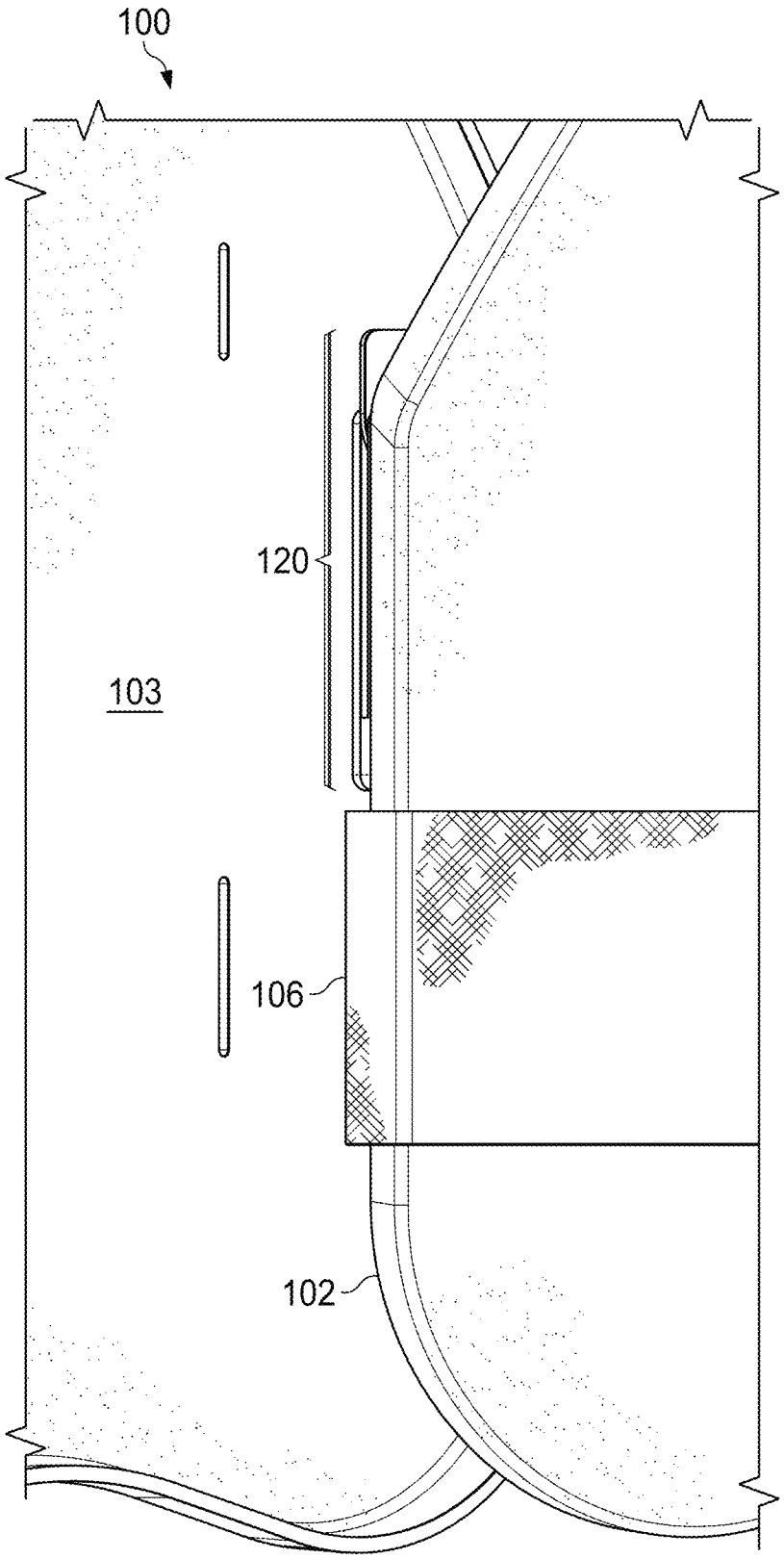
FIG. 4 is a front-facing, exploded perspective view of a portion of the shield of FIG. 1, in which the weapons bracket is in a retracted position, according to one example.

In the illustrated example, bracket 120 is retractable and designed to be held securely within the shield when not in use, thereby minimizing space requirements and reducing the risk of unintentionally snagging the bracket on obstacles when not in use. FIGS. 1 and FIG. 2A illustrate bracket 120 in an extended or deployed position. FIGS. 2B and FIG. 3-4 illustrate bracket 120 in retracted position.

FIG. 2A is a perspective view of the bracket 120 when in an extended or deployed position, according to one example. FIG. 2B is a perspective view of bracket 120 when in a retracted position. To facilitate transiting bracket 120 between extended and retracted positions, bracket 120 may include a housing portion 210 configured to receive a retractable arm 220. Arm 200 can be configured to selectively extend from, or to retract within, housing portion 210. As shown more clearly in FIGS. 1 and 3, the housing portion 210 of bracket 120 can be securely fastened to vertical load-bearing retention strap 107 (e.g., using multiple fasteners) of panel retention system 110.

Bracket 120 can include a sliding mechanism (e.g., a channel) that allows a portion of bracket 120 to transition between extended and retracted positions, as needed. Bracket 120 can be equipped with a locking mechanism to serve as a detent while being deployed in an extended position. The locking mechanism may include, for example, spring-loaded pins, clamps, or other suitable devices configured to improve stability and to prevent accidental disengagement of bracket 120.

Front cover 101 or back cover 103 (or both) may include an opening through which arm 220 can extend when deployed. Such an opening can be sealable (e.g., using Velcro or a zipper) when arm 220 is retracted within an internal cavity of shield 100. When extended, arm 220 can provide stable and prominent support for certain equipment, such as firearms, thereby facilitating quick and effective offensive responses, while maintaining the protective capabilities of the shield. In some examples, bracket 120 is deployed manually or through a mechanical actuation system, such as a push-button release or a lever mechanism. The deployment mechanism can be designed for quick and intuitive operation, allowing users to extend bracket 120 rapidly and with minimal effort.

FIG. 3 is a rear-facing, exploded perspective view of a portion of the shield 100 of FIG. 1, in which the arm 220 of weapons bracket 120 is in a retracted position, according to one example. In the perspective view shown in FIG. 3, panel(s) 102 are oriented to show a convex side designed to face toward an operator. FIG. 4 provides a different exploded perspective view of the portable ballistic shield 100 of FIG. 1, in which the opposite convex face of panel(s) 102 is shown, with arm 220 of bracket 120 in a retracted position. The convex face of panel(s) 102 is designed to face toward ballistic projectiles (e.g., fired ammunition) for initial impact.

As shown more clearly in FIGS. 3 and 4, when bracket 120 is in a retracted position, arm 220 may be positioned entirely or mostly within shield 100, with the majority of arm 220 disposed between opposing faces of housing portion 210. Thus, when in its retracted position, bracket 120 can be fully or mostly housed within shield 100, thereby minimizing space requirements and reducing the risk of unintentionally snagging or damaging arm 220.

FIG. 4 is a front-facing, exploded perspective view of a portion of the shield of FIG. 1, in which the weapons bracket is in a retracted position, according to one example.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context. To aid the Patent Office, and any readers of any patent issued on this application, in interpreting the claims appended hereto, applicant notes that there is no intention that any of the appended claims invoke 35 U.S.C. § 112(f) as it exists on the date of filing hereof unless the words "means for" or "step for" are explicitly used in the claim language.

In the foregoing descriptions, for purposes of explanation, numerous specific details are set forth to provide a thorough understanding of one or more examples. However, this disclosure may be practiced without some or all these specific details, as will be evident to one having ordinary skill in the art. In other instances, well-known process steps or structures have not been described in detail in order not to unnecessarily obscure this disclosure. In addition, the foregoing description is not intended to limit the disclosure to the described examples. To the contrary, the description is intended to cover alterations, modifications, substitutions, and equivalents as may be included without departing from the scope defined by the appended claims.

What is claimed is:

1. A portable shield, comprising:

a first cover;

a second cover configured to couple to the first cover and to thereby form a cavity between the first and second covers;

a panel configured to fit within the cavity and to resist penetration of a projectile having a kinetic energy greater than 500 foot-pounds;

a panel retention system coupled to the first or second shield cover and configured to bear the load of the panel and to hold the panel in a fixed place within the cavity; and a weapon support bracket coupled to the panel retention system and having a bracket arm selectively moveable between an extended position and a retracted position, the extended position extending the bracket arm beyond respective edges of the first and second shield covers, the bracket arm providing a surface configured to support the forend portion of a firearm.

2. The shield of claim 1, wherein the weapon support bracket has a housing coupled to the panel retention system, the housing configured to enclose at least a portion of the bracket arm when in the retracted position.

3. The shield of claim 2, wherein housing has a channel configured to permit the bracket arm to slide therethrough in transitioning between the extended position and the retracted position.

4. The shield of claim 1, wherein the first and second covers are fully detachable from one another.

5. The shield of claim 1, wherein the weapon support bracket is configured to releasably lock the bracket arm in the extended position.

6. The shield of claim 1, wherein the first cover has a first lip extending from a periphery thereof, the second cover has a second lip extending from a periphery thereof, and the first and second lips are configured to engage one another.

7. The shield of claim 1, wherein the panel retention system includes a retention strap configured to extend through first and second openings in the second cover.

8. The shield of claim 7, wherein the retention strap is configured to synch the shield against a forearm of an operator.

9. The shield of claim 7, wherein the retention strap includes a handle configured to removably attach hardware to the shield.

10. The shield of claim 7, wherein the retention strap is configured to couple an energy-absorbing pad to the shield.

11. The shield of claim 1, wherein the panel retention system includes first and second load-bearing straps arranged orthogonal to one another in a cross-configuration, the first and second straps each configured to wrap around the panel.

12. The shield of claim 1, wherein the first cover has a top edge having a first end-to-end length, and the first cover has a bottom edge having a second end-to-end length greater than the first end-to-end length.

13. The shield of claim 1, wherein the panel has a contiguous, unperforated volume between opposing surfaces of the panel.

14. The shield of claim 1, wherein the panel, when held by the panel retention system in the fixed place within the cavity, has a contiguous surface opposing the second cover, the contiguous surface of the panel being spaced apart from an opposing inner surface of the second cover by at least 1 inch along at least a 10-inch axis.

15. A portable shield, comprising:

a shield cover having a handle system configured to facilitate manual operation, the shield cover having an internal cavity having sufficient volume to receive a removable ballistic-resistant panel;

a panel retention system coupled to the shield cover and configured to bear the load of the panel and to hold the panel in a fixed place within the internal cavity; and a weapon support bracket coupled to the panel retention system and having a bracket arm selectively moveable between an extended position and a retracted position, the extended position extending the bracket arm beyond an edge of the shield cover and providing a surface configured to support the forend portion of a firearm.

16. The shield of claim 15, wherein the weapon support bracket has a housing configured to enclose at least a majority of the bracket arm when in the retracted position.

17. The shield of claim 15, wherein the wherein the panel meets the ballistic protection levels HG1, HG2, and RF1 of the National Institute of Justice Standard 0123.00.

18. The shield of claim 15, wherein the wherein the panel is configured to prevent penetration of a projectile having kinetic energy greater than 500 foot-pounds.

19. The shield of claim 15, wherein the wherein the panel is configured to prevent penetration of a projectile having kinetic energy greater than 2,000 foot-pounds.

20. The shield of claim 15, wherein the weapon support bracket is configured to releasably lock the bracket in the extended position.

* * * * *